US010293970B2

(12) United States Patent
Kistner

(10) Patent No.: US 10,293,970 B2
(45) Date of Patent: May 21, 2019

(54) HIDDEN DISPLAY CASE

(71) Applicant: INTERNATIONAL PAPER COMPANY, Memphis, TN (US)

(72) Inventor: Matthew Wayne Kistner, Hudson, WI (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 21 days.

(21) Appl. No.: 15/386,644

(22) Filed: Dec. 21, 2016

(65) Prior Publication Data

US 2018/0168367 A1 Jun. 21, 2018

(51) Int. Cl.
*B65D 5/00* (2006.01)
*B65D 5/52* (2006.01)

(52) U.S. Cl.
CPC ..... *B65D 5/00* (2013.01); *B65D 5/52* (2013.01)

(58) Field of Classification Search
CPC . A47F 5/114; A47F 5/101; B31D 5/00; B65D 5/00; B65D 5/52; B65D 5/0236
See application file for complete search history.

(56) References Cited

U.S. PATENT DOCUMENTS 1,902,566 A * 3/1933 Marsh ..... A47F 5/114 211/72
3,554,402 A 1/1971 Lock
3,568,911 A 3/1971 Bebout
3,664,494 A 5/1972 Mergens
3,869,077 A 3/1975 Tuura
3,917,158 A 11/1975 Dorofachuk et al.
3,944,128 A 3/1976 Hogan
4,401,255 A * 8/1983 Conroy ..... B65D 5/08 229/155
5,752,597 A * 5/1998 Brangle, Jr. ..... B65D 5/4208 206/45.21
5,842,576 A * 12/1998 Snow ..... B65D 5/5445 206/736
6,158,579 A * 12/2000 Rosenbaum ..... B65D 5/48026 206/45.29
6,371,365 B1 4/2002 Doucette et al.
6,402,021 B1 * 6/2002 Heathcock ..... B65D 5/5445 229/117.16
6,499,655 B1 12/2002 Moen
6,874,679 B2 4/2005 Tibbles et al.
(Continued)

*Primary Examiner* — Ko H Chan
(74) *Attorney, Agent, or Firm* — Michael D. Folkerts; Thomas W. Ryan

(57) ABSTRACT

A folded blank for forming a display case and a display case formed from the folded blank. The folded blank comprises a one-piece blank including a first side panel, a front panel, a second side panel and a back panel connected in series at respective first, second and third vertical fold lines. The first side panel is folded about the first vertical fold line and is engaged on a first portion of the front panel at a first manufacturer's joint strip. The back panel is folded about the third fold line and has a second manufacturer's joint strip engaged on the first side panel. The first portion forms a tear-away section defined by at least one separation line on the front panel. The first manufacturer's joint strip retains the tear-away section in engagement with the first side panel during erection of the folded blank to form the display case having a display window and a front display case lip.

19 Claims, 6 Drawing Sheets

(56) References Cited

U.S. PATENT DOCUMENTS

| | | | | |
|---|---|---|---|---|
| 7,080,736 | B2 | 7/2006 | Jackson et al. | |
| 7,472,819 | B1 | 1/2009 | Wachter | |
| 7,607,566 | B2 | 10/2009 | Philips et al. | |
| 8,328,079 | B2 * | 12/2012 | Kohler | B65D 5/0227 206/427 |
| 8,800,854 | B2 | 8/2014 | Chapman et al. | |
| 9,061,791 | B2 | 6/2015 | Cameron | |
| 9,938,040 | B2 * | 4/2018 | Buscema | B31B 50/262 |
| 9,994,356 | B2 | 6/2018 | Couture | |
| 2001/0000203 | A1 * | 4/2001 | Yuhas | B65D 5/52 206/750 |
| 2005/0155905 | A1 * | 7/2005 | Monk | B65D 5/443 206/751 |
| 2015/0060538 | A1 | 3/2015 | Laughman et al. | |
| 2018/0168367 | A1 | 6/2018 | Kistner | |
| 2018/0168368 | A1 | 6/2018 | Kistner | |

* cited by examiner

HIDDEN DISPLAY CASE

RELATED APPLICATIONS

This application is related to U.S. patent application Ser. No. 15/386,798 entitle "HIDDEN DISPLAY CASE WITH OFFSET CENTER SEAM GLUE JOINT," filed concurrently herewith, which is hereby incorporated by reference in its entirety.

FIELD OF THE INVENTION

The present invention relates to improvements in containers and, more particularly, to a container configured as a display case having a display window formed at one side of the display case.

BACKGROUND OF THE INVENTION

A half slotted container (HSC) is a common construction for forming corrugated cardboard containers. This type of container is typically formed from a blank that includes front, back and side wall panels connected in series at vertical edges along fold lines, and lower flaps may extend from lower edges of the panels for folding inwardly to form a container bottom. The blank can be folded about the vertical edges to position an end of the blank defining an edge of a side panel in association with an opposing end of the blank defining an edge of one of the front or back panels to form a joint that is typically adhered together by a manufacturer to form a rectangular tube. The blank formed with the manufacturer's joint can be collapsed and provided to an end user where the blank can be reconfigured to a rectangular tube and the flaps folded perpendicular to the panels to form a bottom surface for the container.

SUMMARY OF THE INVENTION

In accordance with an aspect of the invention, a folded blank is provided for forming a display case. The folded blank comprises a one-piece blank including a first side panel, a front panel, a second side panel and a back panel connected in series at respective first, second and third vertical fold lines. The first side panel is folded about the first vertical fold line and has a first manufacturer's joint strip engaged on a first portion of the front panel. The back panel is folded about the third fold line and has a second manufacturer's joint strip engaged on the first side panel. A tear-away section is defined by at least one separation line on the front panel and defines the first portion having the first manufacturer's joint strip. The first manufacturer's joint strip retains the tear-away section in engagement with the first side panel during formation of an erected case in which the side panels are pivoted to a position perpendicular to the back panel.

A second portion of the front panel may extend between the first and second side panels and define a front lip, and the tear-away section may separate from the second portion along the at least one separation line during formation of the erected case.

The at least one separation line may be a horizontally extending separation line defining a lower edge of the tear-away section.

The folded blank may include a vertical separation line defining a first vertical edge of the tear-away section aligned with the second fold line.

The folded blank may include a second vertical edge of the tear-away section spaced from the vertical separation line and pivotally connected to the first side panel at the first fold line.

The first manufacturer's joint strip may be located adjacent to the vertical separation line.

The first manufacturer's joint strip may extend from an upper edge of the first side panel to a vertical location at or above the location of the at least one separation line.

The first side panel may include an overlap tab connected to a main body portion of the first side panel that defines a first fold location between the overlap tab and the first side panel main body portion, which first fold location may be generally aligned with a second fold location between a pivot tab on the tear-away section and a main body part of the tear-away section, and the second manufacturer's joint strip may be located on the overlap tab.

The first and second manufacturer's joint strips may be generally aligned with one another.

The folded blank may include a lower flap attached to a lower edge of each of the panels at a respective horizontal fold line.

In accordance with another aspect of the invention, a display case is provided comprising a front panel including a first portion and a second portion, a back panel parallel to the second portion of the front panel, and first and second side panels connecting the front and back panels. The first portion of the front panel is attached to the first side panel and a first manufacturer's joint strip is engaged between the first portion of the front panel and the first side panel. The second portion of the front panel defines a front lip extending between the first and second side panels.

The first portion of the front panel may define a tear-away section separated from the second portion of the front panel along a separation line, and the second portion of the front panel may define a front lip extending vertically between the separation line and a bottom surface for the display case formed by a flap attached to a lower edge of each of the panels at a respective horizontal fold line.

The tear-away section may be separated from the second side panel along a vertical separation line.

The first side panel may include an overlap tab, and the first side panel may be engaged with the back panel at a second manufacturer's joint strip located on the overlap tab.

The display case may include a pivot tab on the first portion of the front panel adjacent a vertical fold line between the first side panel and the back panel, the pivot tab may extend adjacent and parallel to the back panel.

In accordance with a further aspect of the invention, a method of forming a display case is provided. The method forms the display case from a one-piece blank comprising a first side panel, a front panel, a second side panel and a back panel connected in series at respective first, second and third vertical fold lines, the front panel including a tear-away section defining a first portion of the front panel separated from a second portion of the front panel by at least one separation line. The method comprises applying a first manufacturer's joint strip to the first side panel; folding the first side panel about the first fold line to engage the first side panel on the tear-away section of the front panel; applying a second manufacturer's joint strip to the back panel; folding the back panel about the third fold line to engage the back panel on the first side panel; and pivoting the side panels to a position perpendicular to the back panel, wherein the tear-away section moves with the first side panel to separate from the second portion of the front panel along the at least one separation line and forms an erected case with a display window.

The second portion of the front panel may extend between the first and second side panels and define a front lip for the display case.

Movement of the tear-away section with the first side panel may include separating the tear-away section from the second side panel along a vertical separation line defining a first vertical edge of the tear-away section aligned with the second fold line.

A second vertical edge of the tear-away section spaced from the vertical separation line may be pivotally connected to the first side panel at the first fold line.

A lower flap may be attached to a lower edge of each of the panels at a respective horizontal fold line, and the method may further include folding the flaps about the horizontal fold lines to form a bottom surface for the display case.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

The present description is directed to a container construction comprising a half slotted container (HSC) construction that provides a display case having a display window formed by a tear-away section. The described display case can be formed from a blank processed either with equipment designed for this purpose or by hand. For example, the blank may be processed through flexo-folder-gluer machinery to produce a glued, folded blank that can be opened using currently available case erector machinery or can be produced through manually executed steps, or through a combination of machine implemented and manual steps.

Figure 1:
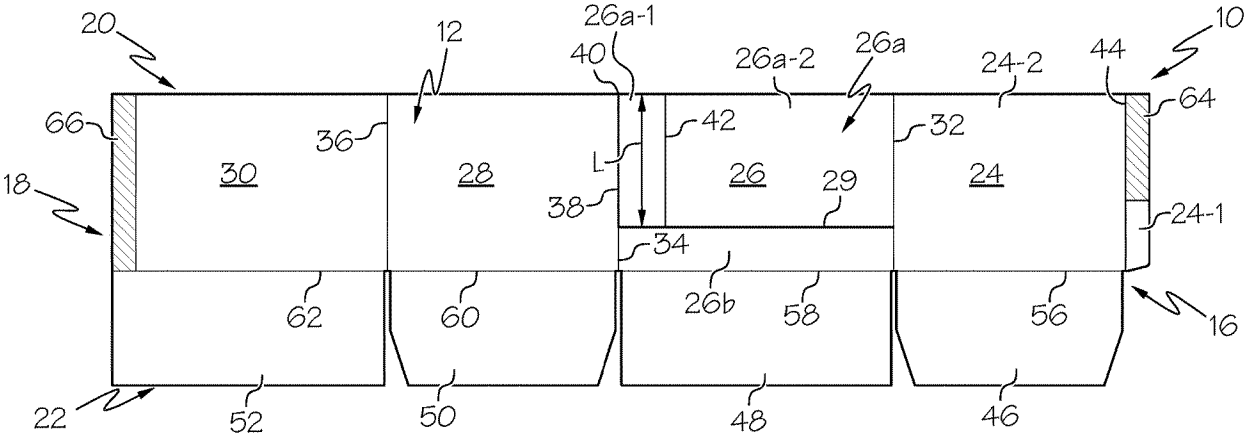
FIG. 1 is a plan view of a blank for forming a display case.
Figure 2:
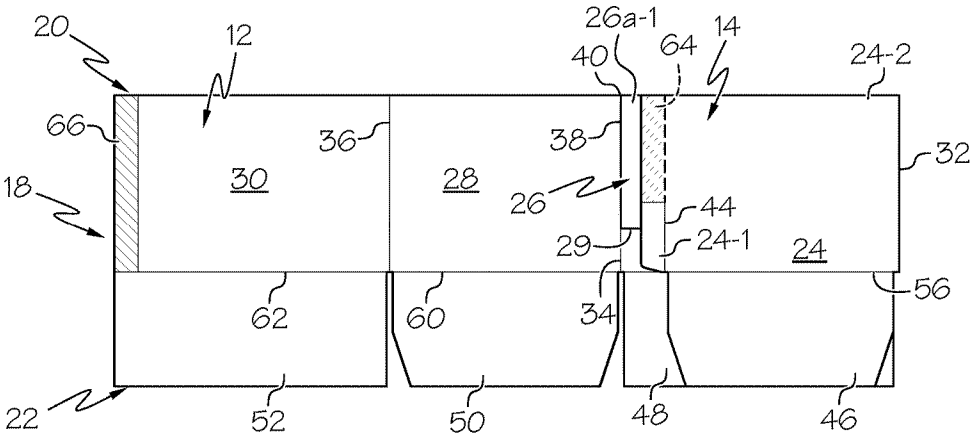
FIG. 2 is a plan view illustrating a first fold of the blank of FIG. 1.

Referring to FIG. 1, a die cut blank 10 is shown for illustrating one or more aspects of the display case described herein. In a use of the blank to form a one-piece display case 8, see FIG. 7, the blank 10 may be formed of a corrugated cardboard material and may be die cut to the shape shown herein, although other materials and variations of the illustrated shape may be provided within the scope of the display case described and claimed herein. The blank 10 illustrated in FIG. 1 is a planar piece of material in which an inner side 12 is shown facing out of the page and an outer side 14, see FIG. 2, is facing an opposite direction from the inner side 12.

As seen in FIG. 1, the blank 10 extends in a longitudinal direction between first and second longitudinal edges, generally designated 16 and 18, respectively, and further extends in a lateral direction between first and second lateral edges, generally designated 20 and 22, respectively. The blank 10 comprises a first side panel 24, a front panel 26, a second side panel 28 and a back panel 30 connected in series. The first side panel 24 is connected to the front panel 26 at a first vertical fold line 32, the front panel 26 is connected to the second side panel 28 at a second vertical fold line 34, and the second side panel 28 is connected to the back panel 30 at a third vertical fold line 36.

The front panel 26 comprises a separation line 29 extending from the first vertical edge 38 to the first vertical fold line 32 and defines a first portion 26*a* or tear-away section above the separation line 29, and defining a second portion 26*b* or front lip below the separation line 29. In the illustrated embodiment, the separation line comprises a horizontal straight line. However, the separation line 29 could be generally horizontal yet have other line shapes, such as an arc or have an oscillating shape, e.g., a sine wave, triangular wave, square wave or sawtooth wave. It is also contemplated that the separation line 29 could be non-horizontal such that it extends at an angle to horizontal. The separation line 29 could also include plural lines or line segments connected in series, e.g., in different angled orientations or with different or varying arcs, to form a continuous extending line between the first vertical edge 38 and the first vertical fold line 32. The first portion 26*a* extends in the longitudinal direction between a first vertical edge 38 of the tear-away section and a second vertical edge that coincides with the first vertical fold line 32. The first vertical edge 38 is defined at a vertical separation line 40 aligned with the second vertical fold line 34. The vertical separation line 40 extends a distance L from the first lateral edge 20, i.e., the upper edge of the blank 10, to the separation line 29. The separation lines 29, 40 may be defined, for example, by a perforated line, or a cut line that extends completely through the material, and may comprise a partial cut though at least one layer of the corrugated material or a cut line interrupted by short sections of bridging (uncut) material. As will be further understood from the description below, the separation lines 29, 40 form structurally weakened lines on the front panel 26 that can permit separation of the first portion 26*a* from both the second portion 26*b* and the second side panel 28 during formation of the display case 8. In embodiments of the invention, the blank 10 is formed with at least a limited attachment of the first portion 26*a* to the second portion 26*b* and/or to the second side panel 28 to maintain the first portion 26*a* generally planar with both the second portion 26*a* and the second side panel 28 in order to facilitate processing of the blank 10 prior to formation of the erected display case 8.

The first portion 26*a* of the front panel 26 is additionally formed with a pivot tab 26*a*-1 defined by a strip of material located between the first vertical edge 38 and a main body 26*a*-2 of the first portion 26*a*. The pivot tab 26*a*-1 is joined to the main body 26*a*-2 along a pivot tab fold line 42 comprising, for example, a score line or perforated line defining a location for the pivot tab 26*a*-1 to pivot relative to the main body 26*a*-2 during formation of the erected display case 8.

The first side panel 24 is additionally formed with an overlap tab 24-1 defined by a strip of material attached to a main body 24-2 of the first side panel 24. The overlap tab 24-1 defines a glue area for attachment to the back panel 30 and is joined to the main body 24-2 along an overlap tab fold line 44 comprising, for example, a score line or perforated line defining a location for the overlap tab 24-1 to pivot relative to the main body 24-2 during formation of the erected display case 8.

The blank 10 further includes a plurality of lower flaps 46, 48, 50, 52 connected to the first side panel 24, front panel 26, second side panel 28 and back panel 30 along respective horizontal fold lines 56, 58, 60, 62. The lower flaps 46, 48, 50, 52 can be folded to form a display case bottom surface 63, see FIG. 7, as described further below.

Figure 3:
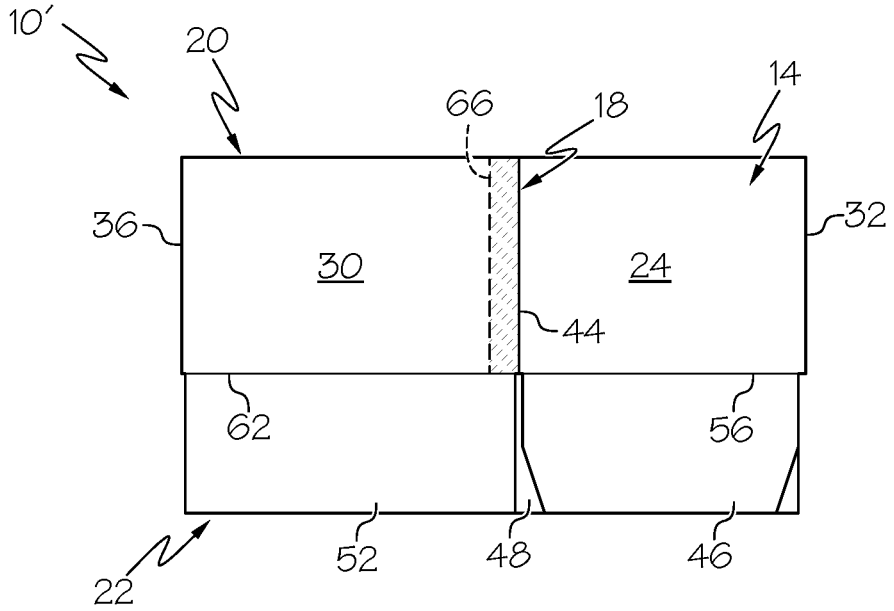
FIG. 3 is a plan view illustrating a second fold of the blank of FIG. 1 to form a glued, folded blank for formation of a display case.
Figure 4:
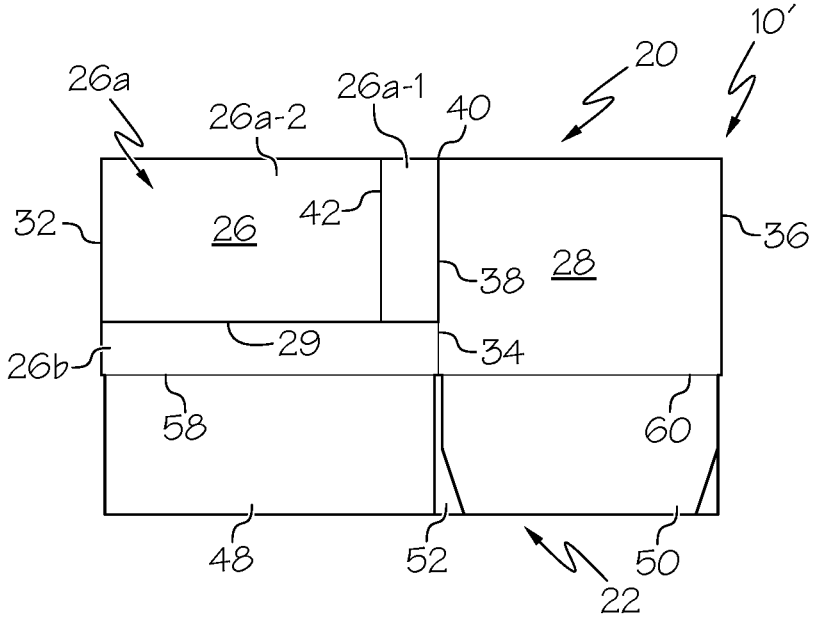
FIG. 4 is a plan view of an opposite side of the glued, folded blank of FIG. 3.

Referring to FIGS. 2-4, an initial series of folding steps is described for forming a glued, folded blank that can subsequently be used in forming the erected display case 8. Although the preferred embodiments presented herein describe applying an "adhesive strip" forming a joint to connect two panels, it should be understood that such a joint or connection between panels can be equivalently formed through other attachment mechanisms connecting the panels together, and may be alternatively referred to as a "manufacturer's joint strip" encompassing , without limitation, gluing, taping, or stitching.

As illustrated in FIG. 1, a first adhesive strip 64, e.g., glue, is applied to the inner side 12 of the blank 10 at the overlap tab 24-1. As illustrated in FIG. 2, the first side panel 24 is folded about the first vertical fold line 32 to overlap the front panel 26 and adhesively, i.e., fixedly, engage the first side panel 24 on the first portion 26*a*. More specifically, the width of the pivot tab 26*a*-1 from the first vertical edge 38 to the pivot tab fold line 42 is such that the overlap tab fold line 44 generally aligns with the pivot tab fold line 42 and the adhesive strip 64 is adhesively attached to the pivot tab 26*a*-1 and preferably not to the main body 26*a*-2 of the first portion 26*a*. It should be noted that the adhesive strip 64 is applied to the overlap tab 24-1 along a vertical length no greater than and preferably less than the length L of the vertical separation line 40, as measured from the first lateral edge 20 defining the upper edge of the first side panel 24.

As seen in FIG. 2, a second adhesive strip 66, e.g., glue, is applied to the inner side 12 of the back panel 30 adjacent to the second longitudinal edge 18. A width dimension of the second adhesive strip 46, as measured in the longitudinal direction, is equal to or less than a width dimension of the overlap tab 24-1. As illustrated in FIG. 3, the back panel 30 is folded about the third vertical fold line 36 to overlap the second side panel 28 such that the back panel 30 adhesively, i.e., fixedly, engages the first side panel 24. More specifically, the longitudinal dimension of the back panel 30 is such that the second longitudinal edge 18 generally aligns with the overlap tab fold line 44 on the first side panel 24 and the second adhesive strip 66 is adhesively attached to the overlap tab 24-1 at the outer side 14 of the first side panel 24. The vertical length of the second adhesive strip 66 may be substantially equal to the vertical length of the overlap tab 24-1 to form a continuous joint from the upper edge of the first side panel 24 to the lower edge of the first side panel 24, as defined at the horizontal fold line 56. Also, the second adhesive strip 66 may be generally aligned in the longitudinal direction, i.e., extending left to right in FIG. 1, with the first adhesive strip 64 so that the second adhesive strip 66 is generally aligned with the first adhesive strip 64 as both extend vertically.

FIGS. 3 and 4 illustrate opposing outer sides of a folded blank 10' having a generally flat configuration such as may be shipped to an end user for formation of the erected display case 8.

Figure 5:
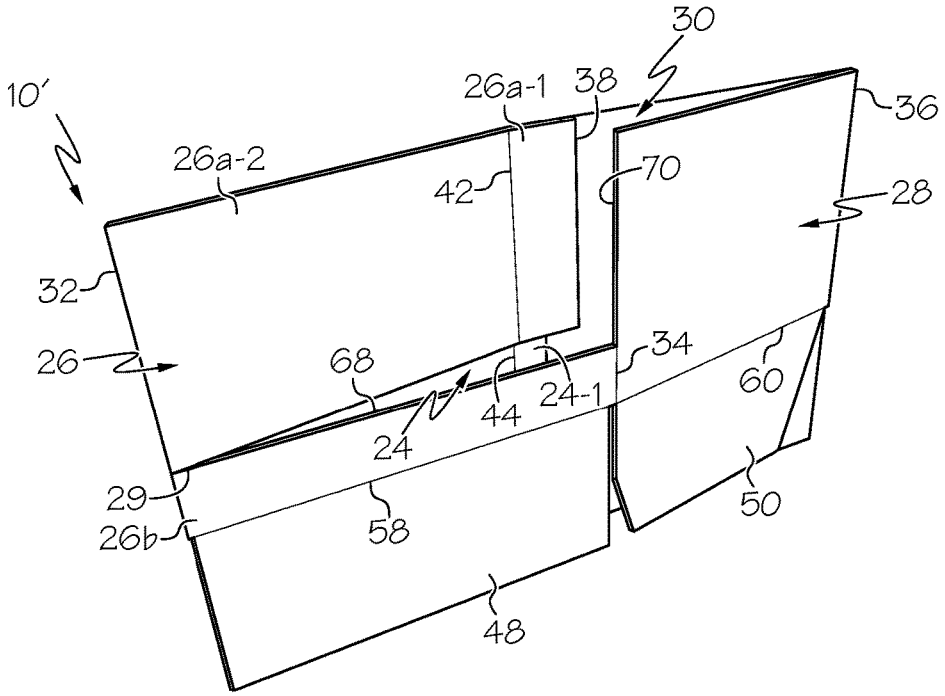
FIG. 5 is a perspective view illustrating an initial step of opening the glued, folded blank to form an erected display case.

FIG. 5 illustrates an initial step in erecting the folded blank 10' to form the display case 8. The folded blank 10' is erected by separating the front panel second portion 26*b* and second side panel 28 from the first side panel 24 and the back panel 30, pivoting the first and second side panels 24, 28 about the overlap tab fold line 44 and the third vertical fold line 36, respectively, to position the first and second side panels 24, 28 perpendicular to the back panel 30. As described above, the first portion 26*a* of the front panel 26 is adhered to the first side panel 24. Hence, the described movement to erect the folded blank 10' results in separation of the tear-away section of the front panel 26, as defined by the first portion 26*a*, separating from the second portion 26*b* along the separation line 29, and at the same time the first vertical edge 38 of the tear-away section, i.e., first portion 26*a*, separates from the second side panel 28 along the vertical separation line 40.

Figure 6:
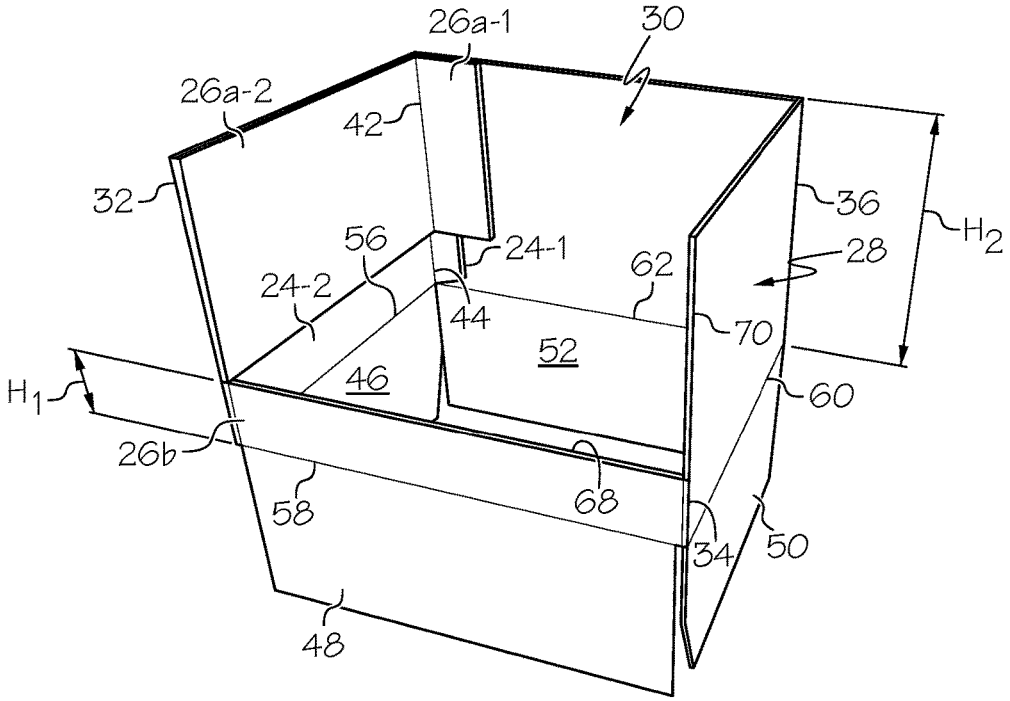
FIG. 6 is a perspective view of the glued, folded blank in a fully open position.
Figure 7:
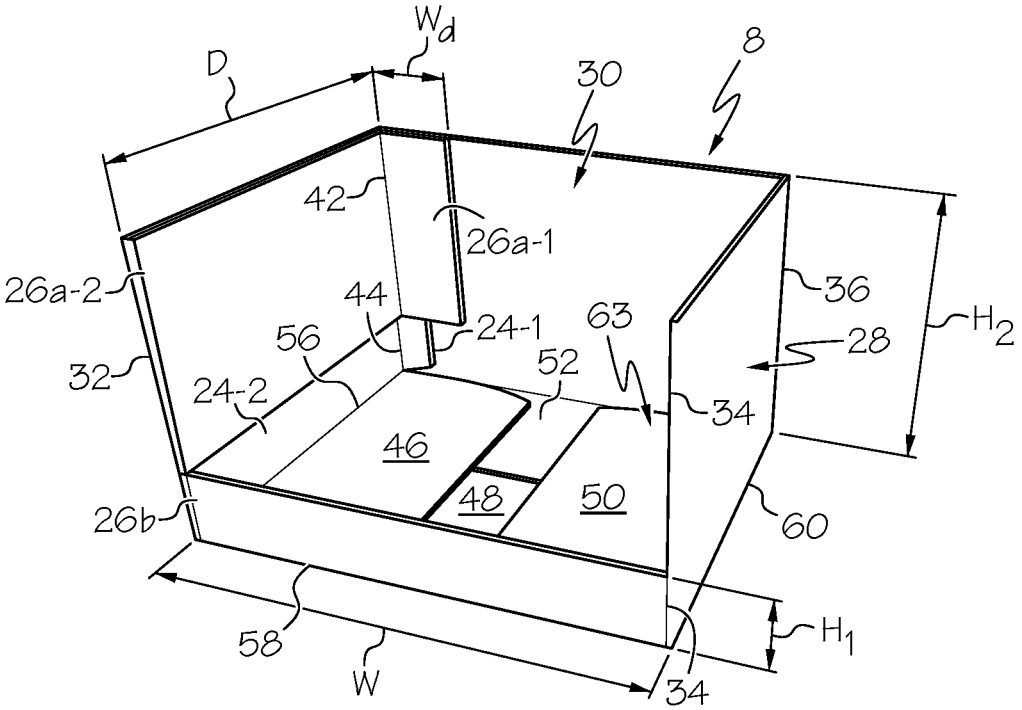
FIG. 7 is a perspective similar to FIG. 6 with the lower flaps folded to complete the display case formed from the blank of FIG. 1.

The described separation of the tear-away section defined by the first portion 26*a* along the separation lines 29, 40 creates a display case window at the remaining second portion 26*b* of the front panel 26. In particular, as seen in FIGS. 6 and 7, the second portion 26*b* defines a vertical front display case lip, extending horizontally from the first vertical fold line 32 to the second vertical fold line 34, including an upper edge 68 forming a lower boundary of the display case window. The upper edge 68 of the front display case lip may be formed with different line shapes than the horizontal straight line illustrated herein. Specifically, the final shape of the upper edge 68 can be determined by the shape selected for the separation line 29 which, as described above with regard to the configuration of the separation line 29, can be defined by various line shapes and line orientations extending between the first vertical fold line 32 and the second vertical fold line 34.

Vertical side edges of the display case window are defined by the second vertical edge of the tear-away section defined at the first vertical fold line 32, and at a forward edge 70 of the second side panel 28 defined at the location of the vertical separation line 40. In an embodiment of the display case 8, the front display case lip formed by the second portion 26*b* may have a height $H_1$ while the back panel 30 may have a height H2 that is greater than the height $H_1$ and can be selected independently of the height $H_1$, such as may be based on the requirements of the end user.

As a final step in the formation of the display case 8, the lower flaps 46, 48, 50, 52 are folded inwardly to form the bottom case surface 63, see FIG. 7. In particular, as depicted in the illustrated embodiment, the opposing lower flaps 46, 50 can be initially folded in, and the remaining opposing lower flaps 48, 52 can be folded over the lower flaps 46, 50 and affixed in place to form the bottom case surface 63 via adhesive, tape, staples or the like. Alternatively, the opposing lower flaps 48, 52 can be initially folded in, and the remaining opposing lower flaps 46, 50 can be folded over the lower flaps 48, 52.

As illustrated in FIG. 7, the erected display case 8 includes the tear-away section, formed by the first portion 26*a*, as a part of the final display case 8. The main body 26*a*-2 of the first portion 26*a* is located adjacent and extends parallel to the first side wall 24, and the pivot tab 26*a*-1 of the first portion 26*a* is affixed to and overlaps the overlap tab 24-1 and extends adjacent and parallel to a portion of the back panel 30 such that the first and second adhesive strips 24 and 26 are generally aligned with one another. It may be noted that the width dimension W across the display case window for the present embodiment is greater than the depth dimension D along the first side wall 24, from the front lip 26*b* to the back panel 30, wherein a width $W_d$ of the pivot tab 26*a*-1 generally represents the difference between the width dimension W and depth dimension D.

Figure 9:
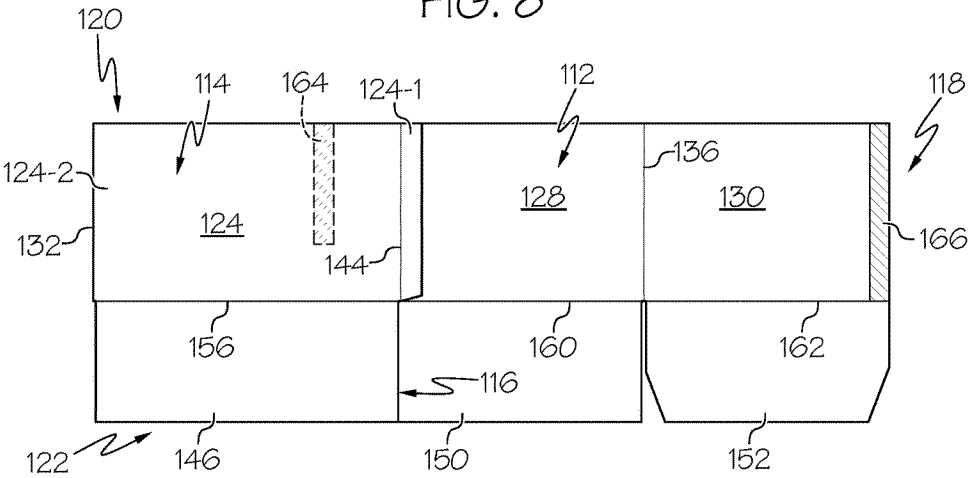
FIG. 9 is a plan view illustrating a first fold of the blank of FIG. 8.
Figure 10:
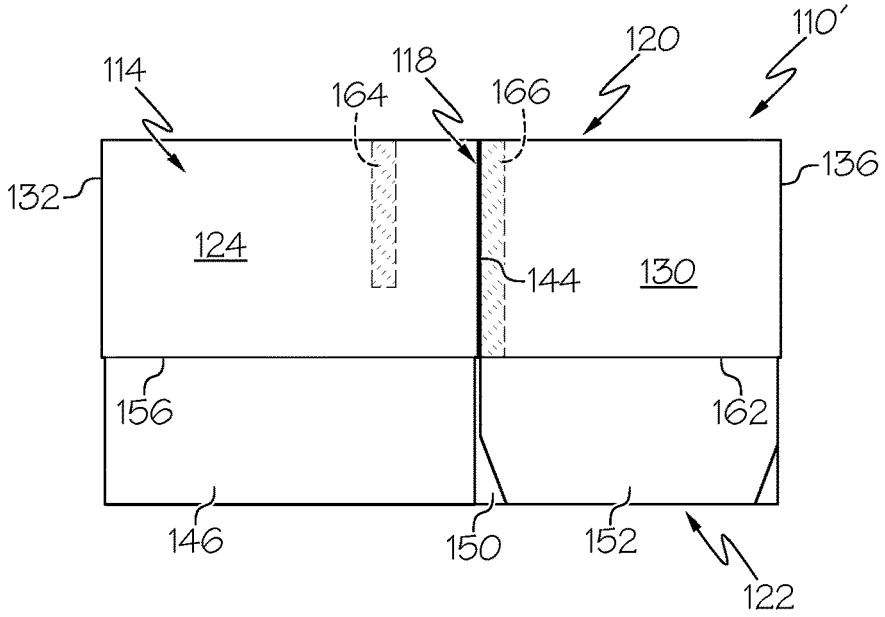
FIG. 10 is a plan view illustrating a second fold of the blank of FIG. 8.
Figure 11:
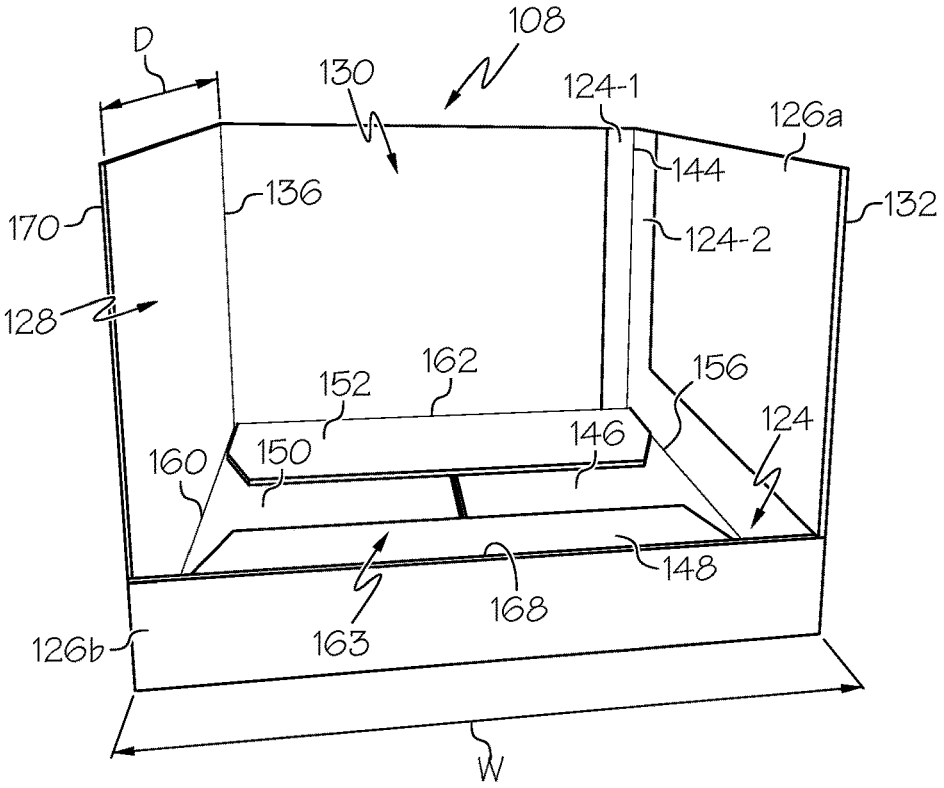
FIG. 11 is a perspective view of a display case formed from the blank of FIG. 8.

FIGS. 8-11 illustrate an alternative configuration for the display case in which a width dimension W of the display case is less than a depth dimension D, see FIG. 11. In the following description of FIGS. 8-11, elements corresponding to similar elements of FIGS. 1-7 are labeled with the same reference numeral increased by 100.

Figure 8:
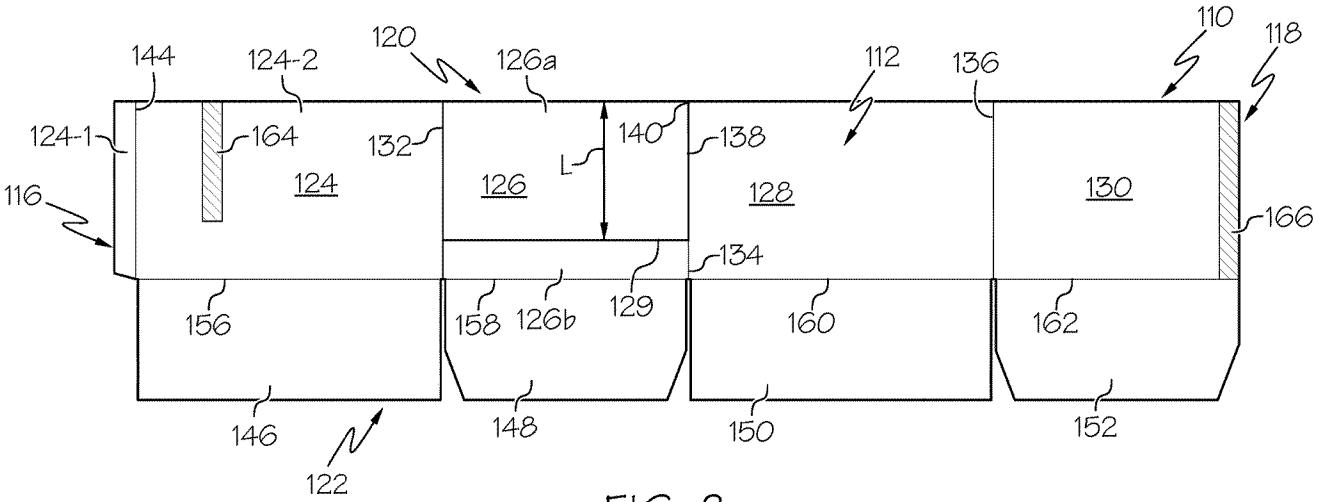
FIG. 8 is a plan view of an alternative configuration of a blank for forming a display case.

Referring to FIG. 8, a blank 110 is illustrated extending in a longitudinal direction between first and second longitudinal edges, generally designated 116 and 118, respectively, and further extends in a lateral direction between first and second lateral edges, generally designated 120 and 122, respectively. The blank 110 comprises a first side panel 124, a front panel 126, a second side panel 128 and a back panel 130 connected in series. The first side panel 124 is connected to the front panel 126 at a first vertical fold line 132, the front panel 126 is connected to the second side panel 128 at a second vertical fold line 134, and the second side panel 128 is connected to the back panel 130 at a third vertical fold line 136.

The front panel 126 comprises a separation line 129 defining a first portion 126*a* or tear-away section above the separation line 129, and defining a second portion 126*b* or front lip below the separation line 129. The first portion 126*a* extends in the longitudinal direction between a first vertical edge 138 of the tear-away section and a second vertical edge that coincides with the first vertical fold line 132. The first vertical edge 138 is defined at a vertical separation line 140 aligned with the second vertical fold line 134. The vertical separation line 140 extends a distance L from the first lateral edge 120, i.e., the upper edge of the blank 110, to the separation line 129. The separation lines 129, 140 may be defined, for example, by a perforated line, or a cut line that extends completely through the material, and may comprise a partial cut though at least one layer of the corrugated material or a cut line interrupted by short sections of bridging (uncut) material. As may be further understood from the description below, the separation lines 129, 140 form structurally weakened lines on the front panel 126 that can permit separation of the first portion 126*a* from both the second portion 126*b* and the second side panel 128 during formation of the display case 108, see FIG. 11. In embodiments of the invention, the blank 110 is formed with at least a limited attachment of the first portion 126*a* to the second portion 126*b* and/or to the second side panel 128 to maintain the first portion 126*a* generally planar with both the second portion 126*a* and the second side panel 128 in order to facilitate processing of the blank 110 prior to formation of the erected display case 108.

The first side panel 124 is additionally formed with an overlap tab 124-1 defined by a strip of material attached to a main body 124-2 of the first side panel 124. The overlap tab 124-1 defines an area for attachment to the back panel 130 at a glued joint and is joined to the main body 124-2 along an overlap tab fold line 144 comprising, for example, a score line or perforated line defining a location for the pivot tab 124-1 to pivot relative to the main body 124-2 during formation of the erected display case 108.

The blank 110 further includes a plurality of lower flaps 146, 148, 150, 152 connected to the first side panel 124, front panel 126, second side panel 128 and back panel 130 along respective horizontal fold lines 156, 158, 160, 162. The lower flaps 146, 148, 150, 152 can be folded to form a display case bottom surface 163, see FIG. 11, as described further below.

Referring to FIGS. 9 and 10, an initial series of folding steps is described for forming a glued, folded blank that can subsequently be used in forming the erected display case 108. A first adhesive strip 164, e.g., glue, is applied to the inner side 112 of the blank 110 at a predetermined location on the first side panel 124, see FIG. 8. The predetermined location on the first side panel 124 is a location spaced from the first vertical fold line 132 a distance less than the width dimension of the front panel 126, as measured in the longitudinal direction between the first vertical fold line 132 and the second vertical fold line 134. As illustrated in FIG. 9, the first side panel 124 is folded about the first vertical fold line 132 to overlap the front panel 126 and adhesively, i.e., fixedly, engage first adhesive strip 164 on the first side panel 124 onto the first portion 126*a*. It should be noted that the adhesive strip 164 is applied to the first side panel 124 along a vertical length no greater than the length L of the vertical separation line 140, as measured from the first lateral edge 120 defining the upper edge of the first side panel 124, such that the first adhesive strip 164 does not engage the front panel second portion 126*b*.

As seen in FIG. 9, a second adhesive strip 166, e.g., glue, is applied to the inner side 112 of the back panel 130 adjacent to the second longitudinal edge 118. A width dimension of the second adhesive strip 166, as measured in the longitudinal direction, is equal to or less than a width dimension of the overlap tab 124-1. As illustrated in FIG. 10, the back panel 130 is folded about the third vertical fold line 136 to overlap the second side panel 128 and adhesively, i.e., fixedly, engage the back panel 130 on the first side panel 124. More specifically, the longitudinal dimension of the back panel 130 is such that the second longitudinal edge 118 generally aligns with the overlap tab fold line 144 on the first side panel 124 and the second adhesive strip 166 is adhesively attached to the overlap tab 124-1 at the outer side 114 of the first side panel 124. The vertical length of the second adhesive strip 166 may be substantially equal to the vertical length of the overlap tab 124-1 to form a continuous joint from the upper edge of the first side panel 124 to the lower edge of the first side panel 124, as defined at the horizontal fold line 156.

FIG. 10 illustrates a folded blank 110' having a generally flat configuration such as may be shipped to an end user for formation of the erected display case 108. The steps for erecting the folded blank form the display case 110' are substantially the same as described above with reference to FIGS. 5-8 to form the display case 8. In particular, as the folded blank 110' is erected, the tear-away section defined by the first portion 126*a* separates from both the upper edge 168 of the front lip, i.e., the second portion 126*b*, and from the forward edge 170 of the second side panel 128 as a result of the first portion 126*a* being affixed to the first side panel 124. The resulting erected display case 108 includes a display case window having a lower edge defined by the upper edge 168 of the second portion 126*b* and vertical side edges defined by the first vertical fold line 132 and the forward edge 170 of the second side panel 128.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A folded blank for forming a display case, the folded blank comprising:

a one-piece blank including a first side panel, a front panel, a second side panel and a back panel connected in series at respective first, second and third vertical fold lines;

the first side panel folded about the first vertical fold line, said first side panel having a first manufacturer's joint strip that is engaged on a first portion of the front panel;

the back panel folded about the third fold line and having a second manufacturer's joint strip engaged on the first side panel;

a tear-away section defined by at least one separation line on the front panel and defining the first portion having the first manufacturer's joint strip; and the first manufacturer's joint strip retaining the tear-away section in engagement with the first side panel during formation of an erected case in which the side panels are pivoted to a position perpendicular to the back panel.

2. The folded blank as set forth in claim 1, wherein a second portion of the front panel extends between the first and second side panels and defines a front lip, and the tear-away section separates from the second portion along the at least one separation line during formation of the erected case.

3. The folded blank as set forth in claim 1, wherein the at least one separation line is a horizontally extending separation line defining a lower edge of the tear-away section.

4. The folded blank as set forth in claim 3, including a vertical separation line defining a first vertical edge of the tear-away section aligned with the second fold line.

5. The folded blank as set forth in claim 4, wherein a second vertical edge of the tear-away section spaced from the vertical separation line is pivotally connected to the first side panel at the first fold line.

6. The folded blank as set forth in claim 4, wherein the first manufacturer's joint strip is located adjacent to the vertical separation line when said first manufacturer's joint strip is in engagement with the first side panel during formation of an erected case.

7. The folded blank as set forth in claim 3, wherein the first manufacturer's joint strip extends from an upper edge of the first side panel to a vertical location at or above the location of the at least one separation line.

8. The folded blank as set forth in claim 1, wherein the first side panel includes an overlap tab connected to a main body portion of the first side panel and defining a first fold location between the overlap tab and the first side panel main body portion, which first fold location is generally aligned with a second fold location between a pivot tab on the tear-away section and a main body part of the tear-away section, and the second manufacturer's joint strip is is adhesively attached to the overlap tab.

9. The folded blank as set forth in claim 1, wherein the first and second manufacturer's joint strips are generally aligned with one another.

10. The folded blank as set forth in claim 1, including lower flaps attached to the lower edges of each of the respective first side panel, front panel, second side panel and back panel panels at the respective horizontal fold lines.

11. A display case comprising:

a front panel including a first portion and a second portion;

a back panel parallel to the second portion of the front panel;

first and second side panels connecting the front and back panels;

the first portion of the front panel attached to the first side panel, and a first manufacturer's joint strip engaged between the first portion of the front panel and the first side panel;

the second portion of the front panel defining a front lip extending between the first and second side panels;

a bottom surface for the display case formed by flaps attached to a lower edge of each of the front, back, and first and second side panels at a respective horizontal fold line; and wherein the first portion of the front panel further defines a tear-away section separated from the second portion of the front panel along a separation line, and the second portion of the front panel further defines the front lip extending vertically between the separation line and the bottom surface.

12. The display case as set forth in claim 11, wherein the tear-away section is separated from the second side panel along a vertical separation line.

13. The display case as set forth in claim 11, wherein the first side panel includes an overlap tab, and the first side panel is engaged with the back panel at a second manufacturer's joint strip that is adhesively attached to the overlap tab.

14. The display case as set forth in claim 13, including a pivot tab on the first portion of the front panel adjacent a vertical fold line between the first side panel and the back panel, the pivot tab extending adjacent and parallel to the back panel.

15. A method of forming a display case from a one-piece blank comprising a first side panel, a front panel, a second side panel and a back panel connected in series at respective first, second and third vertical fold lines, the front panel including a tear-away section defining a first portion of the front panel separated from a second portion of the front panel by at least one separation line, the method comprising:

applying a first manufacturer's joint strip to the first side panel;

folding the first side panel about the first fold line to engage the first side panel on the tear-away section of the front panel;

applying a second manufacturer's joint strip to the back panel;

folding the back panel about the third fold line to engage the back panel on the first side panel; and pivoting the side panels to a position perpendicular to the back panel, wherein the tear-away section moves with the first side panel to separate from the second portion of the front panel along the at least one separation line and forms an erected case with a display window.

16. The method as set forth in claim 15, wherein the second portion of the front panel extends between the first and second side panels and defines a front lip for the display case.

17. The method as set forth in claim 15, wherein movement of the tear-away section with the first side panel includes separating the tear-away section from the second side panel along a vertical separation line defining a first vertical edge of the tear-away section aligned with the second fold line.

18. The method as set forth in claim 17, wherein a second vertical edge of the tear-away section spaced from the vertical separation line is pivotally connected to the first side panel at the first fold line.

19. The method as set forth in claim 15, including a lower flap attached to a lower edge of each of the panels at a respective horizontal fold line, and further including folding the flaps about the horizontal fold lines to form a bottom surface for the display case.

* * * * *